US011781269B2

(12) United States Patent
Stibi et al.

(10) Patent No.: US 11,781,269 B2
(45) Date of Patent: Oct. 10, 2023

(54) DEWATERING DEVICE

(71) Applicant: VOITH PATENT GMBH, Heidenheim (DE)

(72) Inventors: Bernd Stibi, Heidenheim (DE); Thomas Jaschinski, Heidenheim (DE); Robert Attwenger, Vienna (AT)

(73) Assignee: Voith Patent GmbH, Heidenheim (DE)

( * ) Notice: Subject to any disclaimer, the term of this patent is extended or adjusted under 35 U.S.C. 154(b) by 136 days.

(21) Appl. No.: 17/278,477

(22) PCT Filed: Sep. 18, 2019

(86) PCT No.: PCT/EP2019/074945

§ 371 (c)(1),
(2) Date: Mar. 22, 2021

(87) PCT Pub. No.: WO2020/064450

PCT Pub. Date: Apr. 2, 2020

(65) Prior Publication Data

US 2022/0112660 A1 Apr. 14, 2022

(30) Foreign Application Priority Data

Sep. 24, 2018 (DE) ..... 102018123406.6

(51) Int. Cl.
*D21F 1/80* (2006.01)

(52) U.S. Cl.
CPC ..... *D21F 1/80* (2013.01)

(58) Field of Classification Search
CPC ... D21F 1/80; D21F 1/48; D21F 1/483; D21F 1/486; D21F 1/52; D21F 1/523
USPC ..... 162/351, 352
See application file for complete search history.

(56) References Cited

U.S. PATENT DOCUMENTS 4,532,009 A * 7/1985 Nickerson ..... D21F 1/483 162/374
5,562,807 A * 10/1996 Baluha ..... D21F 1/20 162/209
6,752,909 B2 6/2004 Halmschlager et al.
7,918,969 B2 4/2011 McPherson

FOREIGN PATENT DOCUMENTS

DE 10163575 A1 7/2003
EP 0350827 A2 1/1990
EP 1489225 * 12/2004 ..... D21F 1/483
GB 2113264 * 8/1983 ..... D21F 1/009
WO 2018077552 A1 5/2018

OTHER PUBLICATIONS

EP 1489225, English language machine translation, espacenet.org (Year: 2004).*

* cited by examiner

*Primary Examiner* — Eric Hug
(74) *Attorney, Agent, or Firm* — Laurence A. Greenberg; Werner H. Stemer; Ralph E. Locher

(57) ABSTRACT

A dewatering device has a dewatering box and a plurality of dewatering strips. A contour of at least one dewatering strip changes over its length. There is also described a machine for the production of a fibrous web, such as a paper, cardboard or tissue web, with a dewatering device of this kind, and to the use of the latter in a machine of this kind.

12 Claims, 2 Drawing Sheets

DEWATERING DEVICE

BACKGROUND OF THE INVENTION

Field of the Invention

The present invention relates to a dewatering device of a machine for producing a fibrous web, in particular a paper, board or packaging paper web, a combination of dewatering device and fabric, a machine mentioned at the beginning and the use of a dewatering device in such a machine, in detail according to the independent claims.

Dewatering devices of this type comprise a dewatering box with a multiplicity of dewatering strips arranged beside one another at a distance. The dewatering devices are used to support an endless circulating fabric (wire), on which the fibrous web is formed from the fibrous material suspension flowing continuously onto the wire. Here, the underside of the wire sweeps over the upper side of the dewatering strips. It is moved (circulating endlessly) in a direction which then corresponds to the machine direction L as soon as the fibrous web is discharged thereon. The dewatering strip can have a leading edge similar to a doctor. This is additionally serves to carry away the white water which has flowed out of the forming fibrous web through the meshes of the wire and adheres to the underside of the wire. The prior art discloses dewatering devices by means of which individual or all the dewatering strips can be pivoted. Therefore, the angle of inclination of the leading edge is changed. This is because the dewatering performance can be matched to the grade of paper produced, depending on the angle of inclination.

Dewatering devices of the generic type have been disclosed, inter alia, by:

EP 0 350 827 A2

DE 101 63 575 A1

U.S. Pat. No. 7,918,969 B2.

In paper machines, in which the operating conditions change frequently (for example a change of the paper grade, change in wire speed or machine speed, etc.), a change to the aforementioned angle of inclination on the dewatering strips is frequently necessary. In this way, the dewatering path and therefore the dewatering performance are matched to the fibrous web to be produced.

The invention relates to the subjects mentioned at the beginning.

Previously known designs are based on the fact that the upper side of such dewatering strips is constant over the length of the same, which means, for example, that it is flat. It would also be possible to say that the leading edge follows a straight line. The disadvantage with this is that the turbulence level in the region of the dewatering cannot be influenced locally over the width of the fibrous web to be produced.

SUMMARY OF THE INVENTION

The invention is based on the object of avoiding the disadvantages of the prior art. Instead, the intention is to specify a dewatering device which has a different inclination of the leading edge over its length.

The object is achieved by the independent claims. Particularly advantageous and preferred embodiments are illustrated in the dependent claims.

The inventors have recognized that local influencing of the sheet formation of the fibrous web in the width direction is possible as a result of the different adjustment of the angle of inclination of the leading edge over the length of a respective dewatering strip. It is possible for an optimal turbulence level in the region of the dewatering by means of the wire to be set locally over the width of the fibrous web to be produced. In principle, with such a dewatering device, the sheet formation can be influenced at any point of the fibrous web to be produced. Viewed in the width direction of the fibrous web, the dewatering can therefore be guided by the wire speed and the grade of the paper to be produced at an optimal turbulence level provided for the purpose.

With reference to a Cartesian coordinate system, in which the fibrous web and the wire run in an XY plane, the width direction of the fibrous web and of the wire (corresponding to the machine direction) can be the positive X direction, and the running direction of the fibrous web to be produced and of the wire can be the positive Y direction. The thickness direction of the fibrous web and of the wire then results as the Z direction (vertical direction).

The dewatering box having the dewatering strips is located parallel to the XY plane. The receiving plane of the dewatering box for the dewatering strips also runs parallel to this plane.

Starting from this definition, the angle of inclination according to the invention can be measured in the YZ plane as that smallest angle which is delimited by the leading edge and the receiving plane. Here, the leading edge is that edge which is formed by the two sides adjacent to each other, namely the front side and the upper side of the dewatering strip. In this section, which corresponds to the section viewed at right angles to the longitudinal axis of the dewatering strip, the angle of inclination is the smallest angle enclosed by a tangent to the outer contour of the upper side through the leading edge and the receiving plane of the dewatering box with each other.

To describe the finding according to the invention, use is made of a definition via a vertical distance, in each case viewed in a section at right angles through the longitudinal axis of the same dewatering strip. As claimed, this distance is measured between the upper side of the dewatering strip and the receiving plane of the dewatering box, that is to say, for example, in the YZ plane. As also claimed, this distance is based on the leading edge instead of the upper side. Stated more simply or in summary, both definitions protect nothing else than a dewatering strip, the leading edge of which deviates from a rectilinear course along its length. Instead, the leading edge is intended to follow a curve which does not represent a straight line. Therefore, the invention also relates to such a dewatering strip per se. These definitions of the invention are intrinsically interchangeable and equivalent.

A dewatering strip according to the invention is usually longer than the width of the fibrous web to be produced. The longitudinal direction of the dewatering strip corresponds to the width direction of the fibrous web to be produced and is thus perpendicular to the machine direction.

If mention is made of the fact that the vertical distance can be changed, then this means that, starting from a leading edge which just follows a straight line, the dewatering strip can be temporarily deformed permanently such that the result is a leading edge which does not follow a straight line. The vertical distance certainly describes that, in the aforementioned section, the distance between the upper side which is delimited by the leading edge and the receiving plane of the dewatering box changes continuously or discontinuously along the dewatering strip.

The temporary permanent deformation is reversible. To this end, the material of the dewatering strip can be chosen such that it carries out the change in the angle of inclination of the leading edge in the elastic range of the material. It could also be said that the material of the dewatering strip can be designed to be so flexible that it can twist in the elastic range.

The material of the dewatering strip can therefore be a polymer (plastic). Suitable is polymers are, amongst others, POM polyoxymethylene (POM), polyoxymethylene copolymer (POM C), polyethylene (PE) or ultrahigh molecular weight polyethylene (UHMW PE).

The polymer can also be implemented by particles or fibers in the manner of a fiber-reinforced plastic. Fillers, such as glass (glass spheres) or ceramic particles can be embedded in the polymer. The proportion of ceramic particles by weight can be higher than the proportion of plastic.

For example, the dewatering strip can be produced, for example, from glass fiber-reinforced plastic (GRP), wherein a vinyl ester, for example, is used as a matrix material and the proportion of glass fibers is up to 90%. As a rule, ceramic segments are fixed mechanically (with a force fit and/or form fit, for example by means of clamps or a dovetail guide) to this carrier material and/or bonded (integrally) to the strip with a suitable adhesive. Combinations of a force fit, form fit and integral fit are conceivable. Here, for example, two-component epoxy resins, which are stable relative to acids and alkalis, are suitable as an adhesive. These should be stable relative to acids and alkalis since, typically, cleaning agents used on a paper machine contain just such contents. In addition, the adhesive should be stable against hydrolysis. Furthermore, because of the mineral oils used in retention agents, the adhesive can likewise be stable with respect to mineral oil. Here, so-called structural adhesives can be used as possible adhesives. In addition, however, other adhesives, so-called acrylates, for example cyanoacrylate, can also be used in order to fix the ceramic to the GRP.

An individual dewatering strip can also comprise multiple segments along its longitudinal extent. The segmentation can be carried out by slitting, wherein the individual segments then do not have to be separated completely from one another. In such a case, the individual segments still stick to one another, therefore form a single (one-piece) coherent component. In this case, specific separating points or flexible joints can be introduced into the slits between the individual segments. This makes it possible to change the angle of inclination of the leading edge, as will be described further, segment by segment. The joint can be filled with an elastic plastic. The individual segments of the dewatering strip can be connected to one another by a continuous, preferably flexible, seal, for example made of a fluor rubber. As a result, the adjustment mechanism can be sealed off completely.

If the dewatering strip is produced from multiple segments separated from one another, the individual segments can butt flush against one another. The individual segments can then be supported and held independently of one another for the adjustment thereof and adjusted by means of at least one actuator. The latter can be actuable mechanically, hydraulically, pneumatically, electrically or in another way.

In principle, it would be conceivable to assign an adjusting device additionally to one or each of the dewatering strips, by means of which the entire strip could additionally also be adjusted in height and angle. Thus, the individual dewatering strips could be adjusted in their height and/or in their angle in the YZ plane, for example independently of the remaining ones.

In the sense of the invention, a fibrous web is to be understood as a laid or tangled fabric of fibers, such as cellulose, plastic fibers, glass fibers, carbon fibers, additional materials, additives or the like. Thus, the fibrous web can, for example, be formed as a paper, board or tissue web. It can substantially comprise wood fibers, wherein small quantities of other fibers or else additional materials and additives can be present. This is left up to those skilled in the art, depending on use. In a machine for producing such a fibrous web, the longitudinal direction is considerably longer than the width direction of the fibrous web. The longitudinal direction of the fibrous web corresponds substantially to the machine direction L.

BRIEF DESCRIPTION OF THE SEVERAL VIEWS OF THE DRAWING

The invention is to be explained by way of example by using the figures, in which.

DETAILED DESCRIPTION OF THE INVENTION

Figure 1:
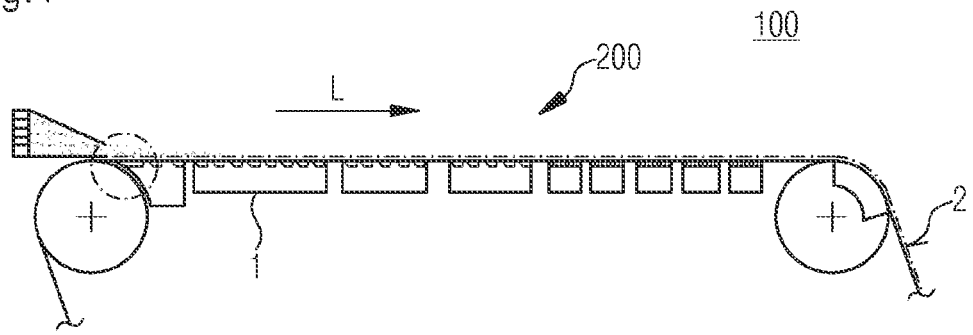
FIG. 1 shows a schematic, partly longitudinally sectional illustration of a wire section of a machine, shown merely as an extract, for producing a fibrous web.

FIG. 1 shows a schematic, partly longitudinally sectional illustration of a wire section 200 of a machine 100, shown merely as an extract, for producing a fibrous web 2 from at least one fibrous material suspension. The image plane corresponds to the YZ plane described at the beginning. The machine direction L extends from left to right here. The fibrous web 2 can be, in particular, a paper (such as packaging paper), board or tissue web. The fibrous material suspension passes from a headbox onto a fabric, here a wire designed as an endless belt, which circulates relative to the dewatering device 1 such that the fibrous web 2 is transported onward by the fabric in the machine direction L. By means of the fibrous material suspension applied to the upper side of the wire, the fibers for forming the fibrous web are deposited there. The excess water from the fibrous material suspension reaches the dewatering device 1 via the underside of the wire. The fibrous web 2 thus formed on the upper side of the wire is transported onward by means of the same in the machine direction L to the next processing station of the machine.

Figure 2:
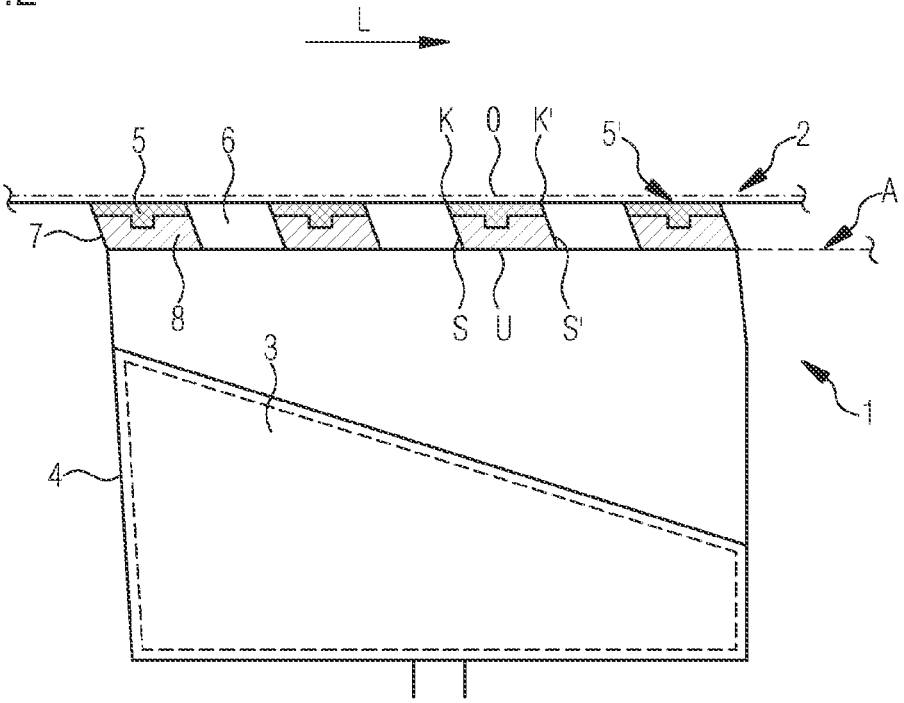
FIG. 2 shows a schematic cross-sectional illustration of an embodiment of a dewatering device.

The basic structure of a dewatering device 1 is shown in FIG. 2 in the same section as in FIG. 1. The dewatering device 1 can be a constituent part of the wire section 200 of the machine 100 illustrated in FIG. 1.

The dewatering device 1 can comprise, for example, a box-like main body (dewatering box 4), which can optionally be acted on by a vacuum source 3, indicated dashed and preferably able to be controlled/regulated. Said vacuum source is used to improve the dewatering of the fibrous material suspension, is assigned to the wire section 200 and in the present case is arranged within the dewatering box 4.

A plurality of dewatering strips 5 extending transversely with respect to the machine direction L (arrow in FIG. 1) and at a distance are arranged on the upper side of the dewatering box 4 that faces the underside of the wire. Here, the upper side of the dewatering box 4, facing the fibrous web or the fabric, forms a receiving plane A. In this receiving plane, the dewatering strips 5 are held, more precisely by their corresponding underside U.

The dewatering strips 5, viewed in the machine direction L, which corresponds to the running direction of the fibrous web 2 to be produced in the machine, are arranged at a distance from one another. In the present case, these are arranged parallel and at a distance from one another with regard to their longitudinal axes, which extend transversely to the machine direction L into the image plane.

In each case, two directly adjacent dewatering strips 5 together delimit a dewatering slit 6 at their front sides S, S' facing each other. If the dewatering strips 5 are arranged as illustrated in FIG. 2, then they preferably form with one another a dewatering surface 5' that is flat and has multiple dewatering slits 6. Said dewatering surface extends substantially parallel to the wire circulating relative thereto and to the fibrous web 2 to be produced thereon and relative to the receiving plane A of the dewatering box 4.

Each of the individual dewatering strips 5 can have an upper part 7 facing the wire and a lower part 8 facing the main body 4. The upper part 7 is particularly abrasion-resistant (e.g. produced from a ceramic) and then can be attached, for example, integrally to the lower part 8. However, it is possible that the dewatering strip 5 is also produced in one piece.

As can be viewed in the present illustration, each of the dewatering strips 5 is designed in such a way that a polygonal cross section of the outer contour results. Thus, each dewatering strip 5 has an upper side O, an underside U and at least one front side S. Front side S and upper side O delimit a leading edge K at their transition. The latter is that edge over which the fabric sweeps first in the machine direction L. As already explained, the underside U of the dewatering strip 5 extends, for example, parallel to or in the receiving plane A. Furthermore, in the embodiment illustrated, the dewatering strip 5 has a second front side S', which is opposite the front side S and connects the upper side O and the underside U to each other. Also at the transition of the front side S' to the upper side O, the dewatering strip 5 has an edge, here designated as a trailing edge K'. The trailing edge K', viewed in the machine direction L, is located downstream of the leading edge K. It would also be possible to say that the liquid of the fibrous material suspension flows firstly over the leading edge K and then over the trailing edge K'.

Figure 3A:
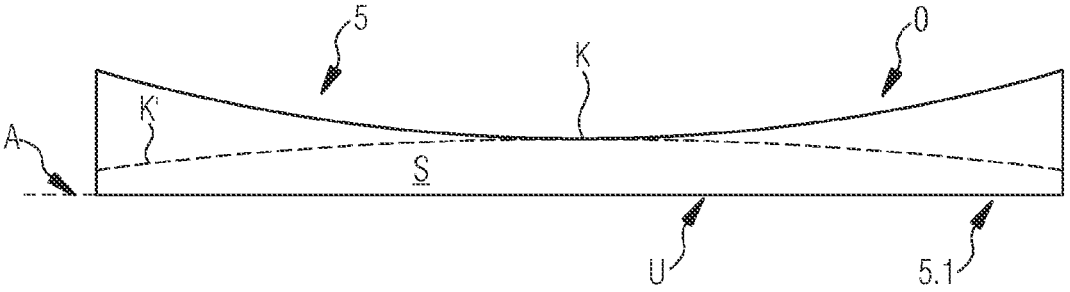
FIG. 3*a* shows a schematic side view, not to scale, of the front side of the dewatering strip, in which the leading edge can be viewed, according to a first embodiment.

FIG. 3*a* shows a view in the machine direction L of the front side S of a dewatering strip 5 of the dewatering box 4 from FIG. 2. This reveals that the leading edge K does not follow a straight line but a curve deviating therefrom. In other words, the vertical distance to be measured (to the receiving plane A) between the receiving plane A and the leading edge K changes in the longitudinal direction in this view, that is to say along the longitudinal axis 5.1 of the dewatering strip 5. It would also be possible to say that the distance of the upper side O and the underside U and the receiving plane A changes continuously along the longitudinal axis 5.1 of the dewatering strip 5.

In principle, it would be conceivable for the dewatering strip 5 to be designed in such a way that the course of the non-straight leading edge K is fixed, that is to say non-variable. In such a case, the upper side O could be designed accordingly, for example ground. The upper side O of the dewatering strip would then be convex or crowned.

However, it would also be conceivable that the non-straight leading edge K does not result permanently but only temporarily. For this purpose, the dewatering strip 5 could initially have a straight leading edge K. This would correspond to an initial position. Starting from this initial position, the entire leading edge would then be intrinsically twisted, for example, in such a way that a leading edge K curved in FIG. 3*a* results over the length of the dewatering strip 5. Thus, the course of the leading edge K would therefore be caused not to change permanently but only temporarily. After a predefinable time or upon request, this could return to the initial position. The dewatering strip 5 could, for example, be twisted in such a way that the center is rotated about the longitudinal axis 5.1 of the dewatering strip 5 with respect to the firmly held axial ends. The result would likewise be the leading edge K illustrated in FIG. 3*a*. The dashed line indicates the resultant trailing edge K' which results when the dewatering strip 5 is twisted, as explained.

Irrespective of whether the non-straight course of the leading edge K is then fixed permanently or only temporarily, the result toward the axial edges (viewed along the longitudinal axis 5.1) is a rise in the angle of inclination of the leading edge K. This is illustrated schematically in FIG. 3*b*, which shows a top view of the upper side O of the dewatering strip 5. Thus, the result is an angular change, more precisely an increase in the angle of inclination with respect to the center (here) 0°) toward the axial ends (here: 0.4°). Between the center and the axial ends, the result is a smooth transition of the angle of inclination when a curve of the leading edge K which likewise extends continuously is chosen. In the region of the axial ends, the angle can also be 2°, 4°, 6°, 8° or 10°. In addition, graduations between the aforementioned values are conceivable.

Figure 4A:
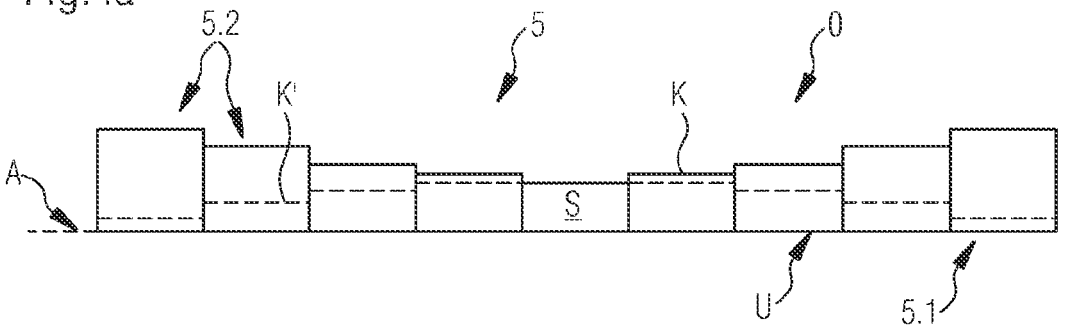
FIG. 4*a* shows a schematic side view, not to scale, of the front side of the dewatering strip, in which the leading edge can be viewed, according to a second embodiment.

The embodiment of FIG. 4*a* shows a modification of the dewatering strip 5 relative to the illustration of FIG. 3*a*. Here, too, a view in the machine direction L of the front side S of the dewatering strip 5 from FIG. 2 is illustrated. The leading edge K, viewed over its entire length or over the entire length of the dewatering strip 5, does not follow a continuous straight line but is designed in steps. The individual steps result from the fact that the dewatering strip is subdivided into a plurality of segments 5.2 arranged along the longitudinal axis 5.1. The illustration of FIG. 4*a* implies that the segments 5.2 are designed separately from one another. However, this does not necessarily have to be the case, for example the dewatering strip 5 could also be slit at right angles to the longitudinal axis 5.1 along its length without the individual segments 5.2 being separated from one another. This would consequently still form a single coherent component.

Here, too, that already stated in relation to FIG. 3*a* applies: the dewatering strip 5 can be designed in such a way that the dewatering strip 5 has the leading edge K illustrated in FIG. 4*a* permanently or else that this can be moved reversibly from an initial position, in which the dewatering strip 5 has a straight leading edge K, into a position which is not straight, and back. Of course, combinations of fixed and reversibly rotatable are conceivable, including in the embodiment of FIG. 3*a*.

Figure 3B:
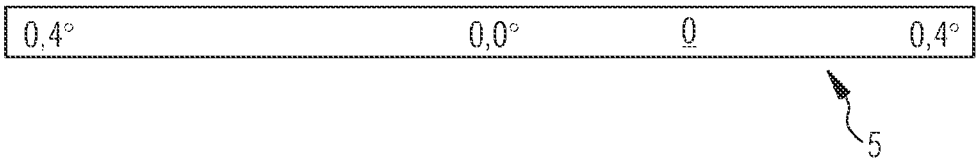
FIG. 3*b* shows a simplified top view of the dewatering strip from FIG. 3*a* with the indication of the extreme positions of the angle of inclination of the leading edge.
Figure 4B:
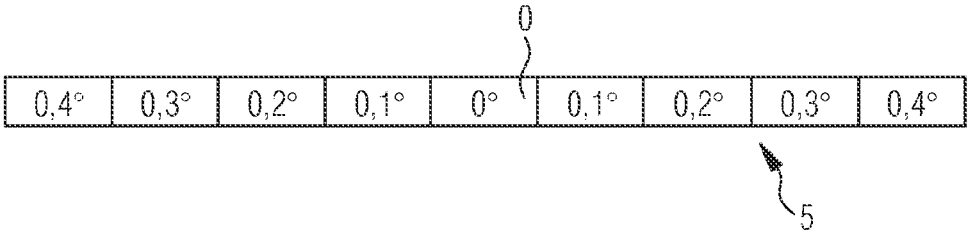
FIGS. 4*b*,4*c* show a simplified top view of the dewatering strip from FIG. 4*a* with the indication of the angle of inclination of the leading edge in each sector.
Figure 4C:
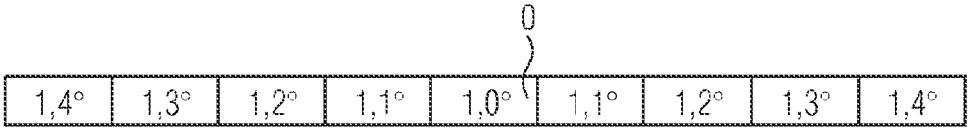

FIGS. 4*b* and 4*c* show a schematic top view of the upper side O of the dewatering strip 5 from FIG. 4*a*, analogously to FIG. 3*b*. It can be viewed that the angle of inclination of the leading edge K rises from the center (here: 0° or 1°) toward the axial ends—here from segment 5.2 to segment 5.2. Thus, this angle at the segment 5.2 located at the axial end can be 0.4° or 1.4°. Larger angular ranges, as explained with reference to FIG. 3*b*, can also be conceivable here.

In principle, the curve of the leading edge K could also extend differently than as shown in FIGS. 3*a* to 4*c*, specifically such that the angle of inclination of the latter is greater in the center and decreases toward the axial ends. In principle, the curve can be continuous in the mathematical sense but can also include discontinuities such as steps, particularly in the case of segmented dewatering strips.

It would also be conceivable to adjust individual or all dewatering strips 5 additionally in height and/or in angle, as explained at the beginning.

The invention claimed is:

1. A dewatering device, comprising:

a dewatering box forming or delimiting a receiving plane;

a multiplicity of dewatering strips disposed on said receiving plane;

at least one of said dewatering strips having a longitudinal axis, an underside facing said receiving plane, and an upper side opposite said underside;

said at least one dewatering strip being formed, in each case viewed in a section perpendicular to the longitudinal axis of said dewatering strip, with a vertical distance between said upper side of said dewatering strip and said receiving plane of said dewatering box continuously or discontinuously varying, or being variable, along the longitudinal axis of said dewatering strip; and said dewatering strip is divided along the longitudinal axis into a multiplicity of segments.

2. The dewatering device according to claim 1, wherein the vertical distance changes from the center in the direction towards respective axial ends of said dewatering strip, viewed along the longitudinal axis.

3. The dewatering device according to claim 2, wherein the vertical distance increases from the center of said dewatering strip toward the axial ends, viewed along the longitudinal direction of said dewatering strip.

4. The dewatering device according to claim 1, further comprising at least one actuator configured to change the vertical distance between said upper side and said receiving plane continuously or discontinuously along the longitudinal axis of said dewatering strip.

5. The dewatering device according to claim 4, wherein said at least one actuator acts in a region of the center and/or in a region of at least one axial end of the dewatering strip.

6. In combination with the dewatering device according to claim 1, a clothing disposed to sweep over said dewatering device along a running direction, and wherein the receiving plane of said dewatering device extends at least partly parallel to said clothing, and the upper side of said dewatering strip faces the cloting.

7. A machine for producing a fibrous web selected from the group consisting of a paper web, a cardboard web, and a tissue web, the machine comprising: a dewatering device according to claim 1, and at least one clothing disposed to sweep over said dewatering device.

8. The dewatering device according to claim 1, wherein said dewatering strip is divided along the longitudinal axis into a multiplicity of segments.

9. The dewatering device according to claim 8, wherein said segments adjoin one another directly.

10. A dewatering device, comprising:

a dewatering box forming or delimiting a receiving plane;

a multiplicity of dewatering strips disposed on said receiving plane;

at least one of said dewatering strips having a longitudinal axis, an underside facing said receiving plane, and an upper side opposite said underside;

said at least one dewatering strip being formed, in each case viewed in a section perpendicular to the longitudinal axis of said dewatering strip, with a vertical distance between said upper side of said dewatering strip and said receiving plane of said dewatering box continuously or discontinuously varying, or being variable, along the longitudinal axis of said dewatering strip;

at least one actuator configured to change the vertical distance between said upper side and said receiving plane continuously or discontinuously along the longitudinal axis of said dewatering strip.

11. The dewatering device according to claim 10, wherein said dewatering strip is divided along the longitudinal axis into a multiplicity of segments.

12. The dewatering device according to claim 11, wherein said segments adjoin one another directly.

* * * * *